United States Patent [19]

Tanaka et al.

[11] 4,366,788

[45] Jan. 4, 1983

[54] INTERNAL COMBUSTION ENGINE

[75] Inventors: Toshiaki Tanaka, Fujisawa; Kazuya Kunii, Yokohama, both of Japan

[73] Assignee: Nissan Motor Company, Limited, Yokohama, Japan

[21] Appl. No.: 192,370

[22] Filed: Sep. 30, 1980

[30] Foreign Application Priority Data

Oct. 30, 1979 [JP] Japan ..... 54-140274

[51] Int. Cl.[3] ..... F02D 17/00

[52] U.S. Cl. ..... 123/198 F; 123/572

[58] Field of Search ..... 123/198 F, 572

[56] References Cited

U.S. PATENT DOCUMENTS 4,106,471 8/1978 Nakajima et al. ..... 123/198 F
4,130,102 12/1978 Churchill ..... 123/198 F
4,201,180 5/1980 Lizuka ..... 123/198 F

FOREIGN PATENT DOCUMENTS 2628091 1/1977 Fed. Rep. of Germany .
2252024 6/1975 France .
1510459 5/1978 United Kingdom .

OTHER PUBLICATIONS

"Automotive Industries" dated Aug. 1, 1961.

*Primary Examiner*—Ira S. Lazarus
*Attorney, Agent, or Firm*—Schwartz, Jeffery, Schwaab, Mack, Blumenthal & Koch

[57] ABSTRACT

A split engine is disclosed which includes first and second groups of cylinders and an intake passage having its downstream portion divided into first and second branches leading respectively to the first and second groups of cylinders. At low load conditions, the second intake passage branch is disconnected from the intake passage and supplied with exhaust gases. A passage is provided which has its one end opening into the crankcase and the other end opening into the first intake passage branch for introducing blow-by gases into the first intake passage branch.

2 Claims, 1 Drawing Figure

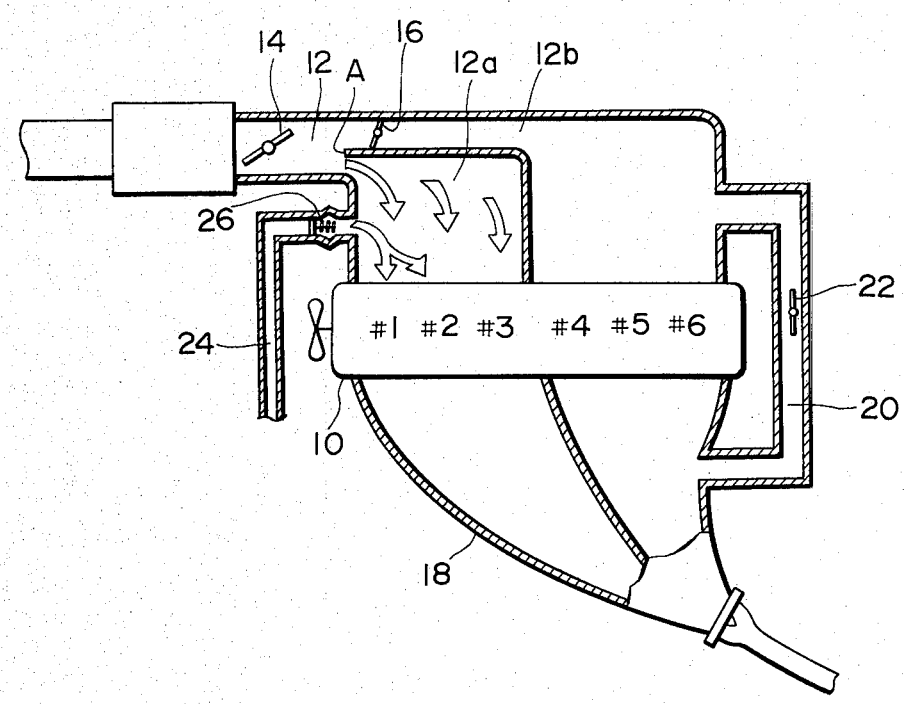
14
12
A
16
12a
12b
26
22
24
#1 #2 #3 #4 #5 #6
20
10
18

INTERNAL COMBUSTION ENGINE

BACKGROUND OF THE INVENTION

1. Field of the Invention

This invention relates to improvements in an internal combustion engine of the split type which will operate on less than all of its cylinders with the remaining cylinders being supplied with exhaust gases reintroduced thereinto under normal or light load conditions.

2. Description of the Prior Art

It is generally known that engine operation is more economical if each cylinder of the engine is run under relatively high loads. However, under most vehicle operating conditions the engine is operating under relatively light loads resulting in uneconomical fuel consumption. Accordingly, it is desired to shift engine operation into a split or part cylinder engine mode wherein the engine operates on less than all of its cylinders such as by cutting off air and fuel flow to the remaining cylinders during normal or light load operation with the remaining cylinders being brought into operation only after the load on the engine exceeds a given value. In this way it is possible to increase the load on each of the active cylinders, which results in greater overall operating economies for the engine.

For the purpose of reducing pumping losses in the inactive cylinders thereby making engine operation more economical, it is common practice to re-introduce exhaust gases into the inactive cylinders so as to maintain them at substantially atmospheric pressure.

In introducing blow-by gases into the intake passage of the split engine in such a manner as is done in normal internal combustion engines, a particularly difficult problem occurs in that the intake system associated with the inactive cylinders is soiled greatly with solid carbon. Blow-by gases, unburned air-fuel mixture leaking from the combustion chamber to the crankcase past the piston rings fitted between the piston and the cylinder wall, include a great amount of oil. The oil sticks to the wall of the intake system associated with the inactive cylinders and combines with soot included in re-introduced exhaust gases to form a pile of solid carbon thereon.

SUMMARY OF THE INVENTION

It is therefore one object of the present invention to provide an improved split type internal combustion engine operable on less than all of its cylinders with the remaining cylinders being supplied with exhaust gases re-introduced thereinto at low load conditions which will be substantially free from formation of solid carbon on the intake system associated with the inactive cylinders.

BRIEF DESCRIPTION OF THE DRAWING

The present invention will be described in greater detail by reference to the following description taken in connection with the accompanying drawing, in which:

The single FIGURE is a schematic sectional view showing one embodiment of a split engine made in accordance with the present invention.

DESCRIPTION OF THE PREFERRED EMBODIMENT

Referring now to the single FIGURE, the reference numeral 10 designates an engine block shown as containing therein a first group of cylinders #1 to #3 being always active and a second group of cylinders #4 to #6 being normally inactive and activated only after the engine load exceeds a predetermined value. The invention is described and illustrated with reference to a six cylinder internal combustion engine, although it is apparent that the invention could be applied to engines having any number of cylinders.

Air or air-fuel mixture to the engine is supplied through an intake passage 12 which has therein a throttle valve 14 drivingly connected to the accelerator pedal (not shown) for controlling air or air-fuel mixture flow to the engine. The intake passage 12 is divided downstream of the throttle valve 14 into first and second branches **12*a* and 12*b*, the first branch 12*a* leading to the first group of cylinders #1 to #3 and the second branch 12*b* leading to the second group of cylinders #4 to #6. In the FIGURE, the letter A designates the point from which the first and second branches 12*a* and 12*b* extend separately toward their associated cylinders. Provided at the entrance of the second branch 12*b* is a stop valve 16 which is normally closed and open to allow the flow of air or air-fuel mixture to the second group of cylinders #4 to #6** only when the engine load exceeds a predetermined value.

An exhaust gas recirculation (EGR) passage 20 is provided which has its one end opening into the exhaust passage 18 of the engine and the other end thereof opening into the second intake passage branch **12*b*. The EGR passage 20 has therein an EGR valve 22 which is open only during a split engine mode of operation to allow recirculation of exhaust gases through the EGR passage 20 into the second intake passage branch 12*b* so as to maintain it at substantially atmospheric pressure. This is effective to minimize pumping losses in the inactive cylinders #4 to #6**, making engine operation more economical.

A blow-by gas passage 24 is provided which has one end opening into the crankcase (not shown) and the other end opening into the first intake passage branch **12*a* for re-introducing thereinto unburned air-fuel mixture leaking from the combustion chambers to the crankcase past the piston rings for re-combustion. The blow-by gas passage 24 has therein a check valve 26 which allows flow only toward the first intake passage branch 12*a***.

The operation of the present invention is as follows: When the engine operates at low load conditions, the stop valve 16 is in its closed position to cut off the flow of air or air-fuel mixture to the second intake passage branch **12*b* so as to bring the second group of cylinders #4 to #6 out of operation. In which case, the EGR valve is open to allow recirculation of exhaust gases into the second intake passage branch 12*b*. Blow-by gases flow through the blow-by gas passage 24 into the first intake branch 12*a* under a suction vacuum appearing therein and hence flow into the first group of cylinders #1 to #3 along with the flow of air or air-fuel mixture from the intake passage 12**.

When the engine load exceeds a given value, the stop valve 16 opens to allow the flow of air or air-fuel mixture through the second intake passage branch **12*b* to the second group of cylinders #4 to #6 with the EGR valve 22 closing to stop the exhaust gas recirculation into the second group of cylinders #4 to #6. In this way, engine operation is shifted from a split engine mode to a full engine mode wherein the engine operates all of its cylinders. In which case, the blow-by gases introduced through the blow-by gas passage 24 into the first intake passage branch 12***a* is driven into the first group of cylinders #1 to #3 by the flow of air or air-fuel mixture from the intake passage 12 thereto. As a result, there occurs a great reduction in the amount of blow-by gases flowing into the second intake passage branch 12*b* and thus in the amount of oil sticking to the wall of the second intake passage branch 12*b*.

If the blow-by gas passage 24 is opened at its one end into the intake passage 12 upstream of the point A as found in conventional arrangements, then a great amount of blow-by gases will flow through the opened stop valve 16 into the second intake passage branch 12*b* and a great amount of oil included in the blow-by gases will stick to the wall of the second intake passage branch 12*b*. The attached oil combines with soot included in the exhaust gases recirculated during a split engine mode of operation to form a pile of solid carbon.

According to the present invention, the blow-by gas passage 24 is opened into the first intake passage branch 12*a* downstream of the point A from which the first and second branches 12*a* and 12*b* extend individually to their associated cylinders. The arrangement is effective to greatly reduce the amount of blow-by gases flowing through the second intake passage branch 12*b* into the second group of cylinders #4 to #6 during a full engine mode of operation. Thus, the amount of oil sticking to the wall of the intake system associated with the second group of cylinders #4 to #6 can be greatly reduced. In this way, it is possible to minimize formation of solid carbon on the wall of the intake system associated with the second group of cylinders #4 to #6 caused by the combination of the oil sticking on the wall of the intake system and soot included in the exhaust gases re-introduced into the second intake passage branch 12*b* during a split engine mode of operation.

It is to be noted that the particular engine shown is only for illustrative purposes and the structure of this invention could be readily applied to any split engine structure including carburetor type engines. While the present invention has been described in conjunction with a specific embodiment thereof, it is evident that many alternatives, modifications and variations will be apparent to those skilled in the art. Accordingly, it is intended to embrace all alternatives, modifications and variations that fall within the spirit and broad scope of the appended claims.

What is claimed is:

1. An internal combustion engine comprising:

(a) a crankcase;

(b) an exhaust passage;

(c) first and second cylinder units each including at least one cylinder;

(d) an intake passage having therein a throttle valve, said intake passage being divided downstream of said throttle valve into first and second branches respectively communicating with said first and second cylinder units, said intake passage second branch having a stop valve near its entrance;

(e) an EGR passage connected from said exhaust passage to said intake passage second branch for recirculating engine exhaust gases into said intake passage second branch, said EGR passage having therein an EGR valve;

(f) means for disabling said second cylinder unit, closing said stop valve, and opening said EGR valve when the engine load is below a predetermined value; and (g) a venting passage opening at its one end into said crankcase and at the other end only into said intake passage first branch for introducing blow-by gases only into said first cylinder unit.

2. The internal combustion engine of claim 1, wherein said venting passage is provided therein with a check valve for blocking fluid flow therethrough from said intake passage first branch.

* * * * *